US006628191B1

(12) United States Patent
Wobben

(10) Patent No.: US 6,628,191 B1
(45) Date of Patent: Sep. 30, 2003

(54) INDUCTANCE ARRANGEMENT

(76) Inventor: Aloys Wobben, Argestrasse 19, 26607 Aurich (DE)

( * ) Notice: Subject to any disclaimer, the term of this patent is extended or adjusted under 35 U.S.C. 154(b) by 0 days.

(21) Appl. No.: 09/720,796

(22) PCT Filed: Feb. 25, 2000

(86) PCT No.: PCT/EP00/01582

§ 371 (c)(1),
(2), (4) Date: May 30, 2001

(87) PCT Pub. No.: WO00/67265

PCT Pub. Date: Nov. 9, 2000

(30) Foreign Application Priority Data

May 3, 1999 (DE) ..... 199 20 268

(51) Int. Cl.[7] ..... H01F 27/24
(52) U.S. Cl. ..... 336/234; 336/55; 336/178
(58) Field of Search ..... 336/212, 234, 336/178, 60, 55, 185, 65

(56) References Cited

U.S. PATENT DOCUMENTS

| | | | | |
|---|---|---|---|---|
| 3,077,570 A | | 2/1963 | Popa | 336/1 |
| 4,080,725 A | * | 3/1978 | Cronk | 336/178 |
| 4,283,842 A | * | 8/1981 | DeLaurentis et al. | 29/606 |
| 4,523,169 A | * | 6/1985 | Hay | 336/60 |
| 5,097,241 A | * | 3/1992 | Smith et al. | 336/60 |
| 5,587,694 A | * | 12/1996 | Minato et al. | 336/65 |

FOREIGN PATENT DOCUMENTS

| | | |
|---|---|---|
| DE | 2103523 | 8/1972 |
| DE | 3505120 C1 | 10/1986 |
| EP | 0847125 A1 | 6/1998 |
| GB | 887081 | 1/1962 |
| GB | 1529967 | 10/1978 |

OTHER PUBLICATIONS

Abstract of DE 3505120, Aug. 17, 1978, esp@@cenet.com database.

* cited by examiner

*Primary Examiner*—Tuyen T. Nguyen
(74) *Attorney, Agent, or Firm*—Dennis M. de Guzman; Seed IP Law Group PLLC

(57) ABSTRACT

An inductance arrangement is directed to inductors, chokes and transformers with a very high power density. Chokes comprise a magnetic circuit and an electrical circuit, the latter usually comprising a copper winding. The inductance arrangement improves cooling of the magnetic circuit, efficiency of the induction arrangement, and reduces the consumption of material for the windings for a lower weight and a reduced structural size. Individual plate packs in the induction arrangement are displaced relative to each other to increase the surface area at both sides of the iron core. Displacement of the plates of the limbs allows for effective cooling passages or ducts between the core and the surrounding winding.

6 Claims, 3 Drawing Sheets

INDUCTANCE ARRANGEMENT

The invention concerns an inductance arrangement or the construction of inductors, chokes and transformers with a very high power density.

Chokes are usual examples of inductance arrangements. Such a choke comprises a magnetic circuit and an electrical circuit, the latter usually comprising a copper winding. Depending on the respective area of use involved the magnetic circuit comprises laminated dynamo plates at lower and medium frequencies, while at higher frequencies it comprises for example ferrite.

Such a choke usually comprises two magnetically conductive limbs which are each enclosed by a respective copper winding and which are magnetically coupled together by yokes, wherein depending on the respective situation of use involved an air gap can be provided between a limb and a yoke. In this respect the inductance of such a choke can be calculated as follows:

(Equation 1)

$$L = \frac{A_{Fe}}{I_{Fe}} \mu_0 \mu_e N^2$$

wherein: $A_{Fe}$ denotes the iron cross-section, $I_{Fe}$ denotes the length of the iron path, N denotes the number of turns, $\mu_0$ denotes relative permeability and $\mu_e$ denotes effective permeability.

Magnetic induction accordingly can be calculated in accordance with the following formula:

$$B = \frac{N \cdot I}{I_{Fe}} \mu_0 \mu_e$$

Magnetic induction is the determining factor in regard to the design of inductive components or transformers. An increase in inductance of the induction B always also means a higher power density.

The iron losses $P_{V,Fe}$ within the magnetic circuit (core) are dependent in a wide range at low frequency in quadratic relationship on the inductance B. This is shown in FIG. 2. With even greater driving of the dynamo plate the iron losses rise very steeply, for which reason that range should generally be avoided. Conventional types of chokes however do not entail the possibility of dissipating high power losses as the iron limbs are insulated from the ambient atmosphere by the coil body, that is to say the copper winding. In this case there is practically no possible way of heat dissipation by radiation (winding over core) or heat dissipation by conduction (air gap). Therefore only a small amount of power loss can be removed from the magnetic circuit.

The object of the present invention is to improve the cooling of the magnetic circuit, to improve the efficiency of the induction arrangement described in the opening part of this specification and to markedly reduce the consumption of material for the windings so that with the same amount of power it is possible to achieve a lower weight and a reduced structural size for the induction arrangement.

In accordance with the invention it is proposed that individual plate packs in the induction arrangement are displaced relative to each other. That drastically increases the surface area at both sides of the iron core. That increase in the cooling area can be easily achieved, by a factor of between five and fifteen. Displacement of the plates of the limbs give rise to highly effective cooling passages or ducts between the core and the surrounding winding.

An increase in the induction B by about 10% also permits a number of turns which is 10% higher. That means however that the inductance increases by about 121% as—see formula 1—that increases in proportion to the square of the number of turns.

It is particularly effective if the mutually displaced plates or mutually displaced plate packs are oriented displaced through 90° with respect to the longitudinal direction of a yoke. In that way the surface can be adjusted to a desired size by virtue of the displacement of the plates without in that case the winding of the adjacent magnetic circuits becoming closer.

The invention is described in greater detail hereinafter by means of an embodiment illustrated in the drawings in which.

Figure 1:
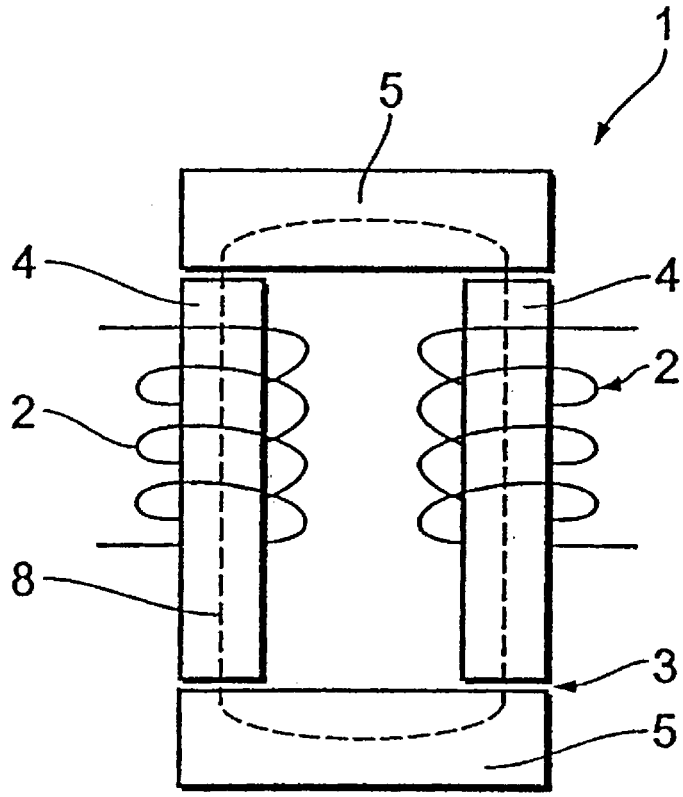
FIG. 1 shows the principle of a magnetic choke.

FIG. 1 shows the structure in principle of an induction arrangement by means of the example of a choke 1. In the illustrated example it comprises a magnetic circuit 8, two electrical circuits 2 and, depending on the respective situation of use involved the magnetic circuit also has an air gap 3. The magnetic circuit in turn comprises four elements, namely two yokes 5 and two limbs 4.

The electrical circuits 2 usually comprise a copper winding or another metal winding.

Depending on the area of use involved the limbs and yokes may comprise laminated dynamo plates 7 when dealing with lower and medium frequencies, while for higher frequencies they preferably also comprise ferrite or iron powder.

Figure 2:
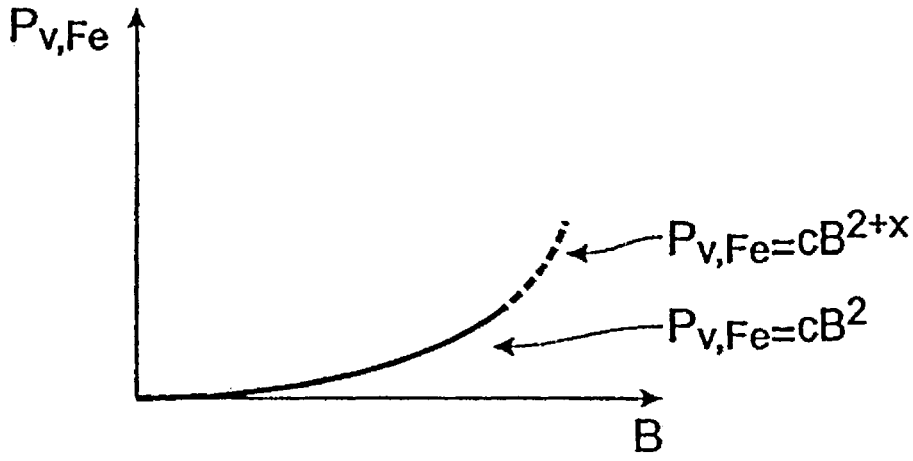
FIG. 2 is a representation of the dependency of the iron losses on induction.

As can be seen from FIG. 2 in the case of conventional inductors the iron losses $P_{V,Fe}$ within the magnetic circuit, that is to say the iron losses of the dynamo sheets, are dependent in a relatively large range at low frequency in quadratic relationship on the induction B.

With an even higher level of actuation (with a still greater level of induction) of the magnetic circuit or the dynamo plates, the iron losses rise very steeply, and for that reason this range should be avoided as far as possible.

In the case of chokes of conventional type the magnetic circuits are not only formed from dynamo plates, but those dynamo plates also form a compact rectangular or square core. That core in turn is surrounded by a closely adjoining electrical circuit, that is to say the copper winding, so that the magnetic core or the limb surrounded by the magnetic circuit are insulated from the ambient atmosphere and are therefore not in a position of adequately removing the heat which is generated. Even if the parts of the limbs, which do not have a winding therearound, are cooled by special means, there is not an adequate possible way of removing the heat which is produced in the limbs by way of heat dissipation by radiation or heat dissipation by conduction. Thus, in spite of considerable structural sizes, only relatively low levels of power loss can be removed from the limbs or the magnetic circuit.

Figure 3A:
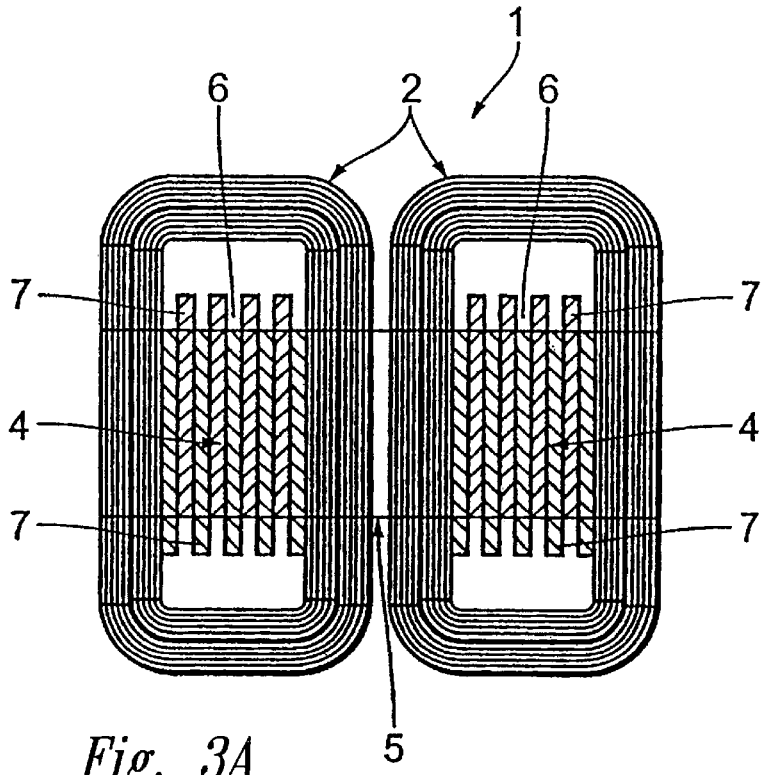
FIGS. 3*a* and 3*b* are a plan view of an induction arrangement according to the invention.
Figure 3B:
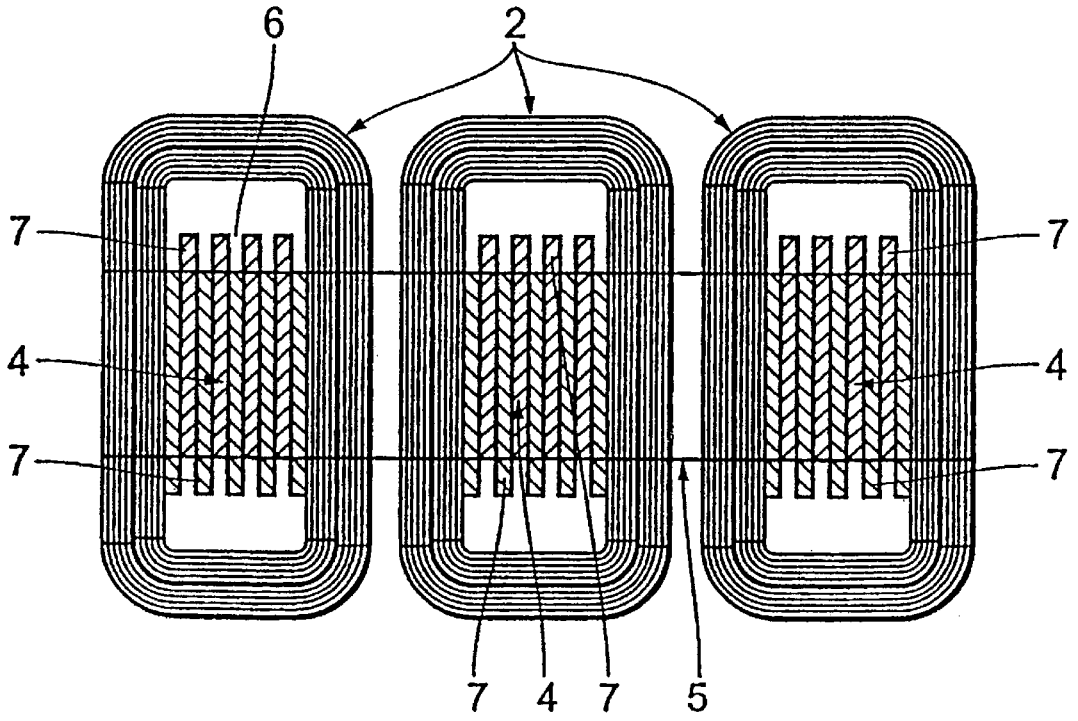

FIG. 3 shows an induction arrangement according to the invention by reference to the example of a choke. It will be seen in this respect that the limbs 4 surrounded by the copper winding 2 comprise a plurality of plates 7 which are displaced relative to each other. In addition the limb plates 7 are oriented displaced through 90° relative to the longitudinal direction of a yoke 5 so that the displacement of the limbs relative to each other means that the original spacing between adjacent limbs is retained. The surface area of the limbs 4 at the sides is drastically increased by virtue of the displacement of the plate packs 7 which can be between about 2 and 10 mm in thickness. The increase in surface area and thus the cooling area by a factor of between five and fifteen can be easily achieved. As the limbs 4 are still surrounded by the copper winding 2, that affords highly effective cooling passages or ducts which, as in the case of a conventional cooling body, are capable of removing the heat which occurs in the limbs due to losses.

The highly intensive cooling of the limbs means that the induction B can be increased without in that case the limb temperatures going into critical ranges. An increase in the induction B by for example 10% also permits a 10% higher number of turns (see equation 2).

As can be seen from equation 1, the number of turns is quadratically involved in the level of the inductance L so that an increase in induction B by 10% is equal to a rise in inductance L to 121%.

As the intensive cooling of the plates provides that they can be better utilised, that means that at the same time the limbs can also be smaller so that their weight is reduced. A reduction in the size of the limbs also at the same time means a reduction in the copper winding lengths, and therefore also represents a considerably lower level of consumption of copper.

That means that the efficiency of the inductance arrangement is considerably improved.

It was found that, by virtue of the steps according to the invention, with the choke power remaining the same, the structural size could be reduced by between about 30 and 500% in comparison with conventional chokes and weight could be reduced by more than 40% in comparison with conventional chokes.

Figure 4:
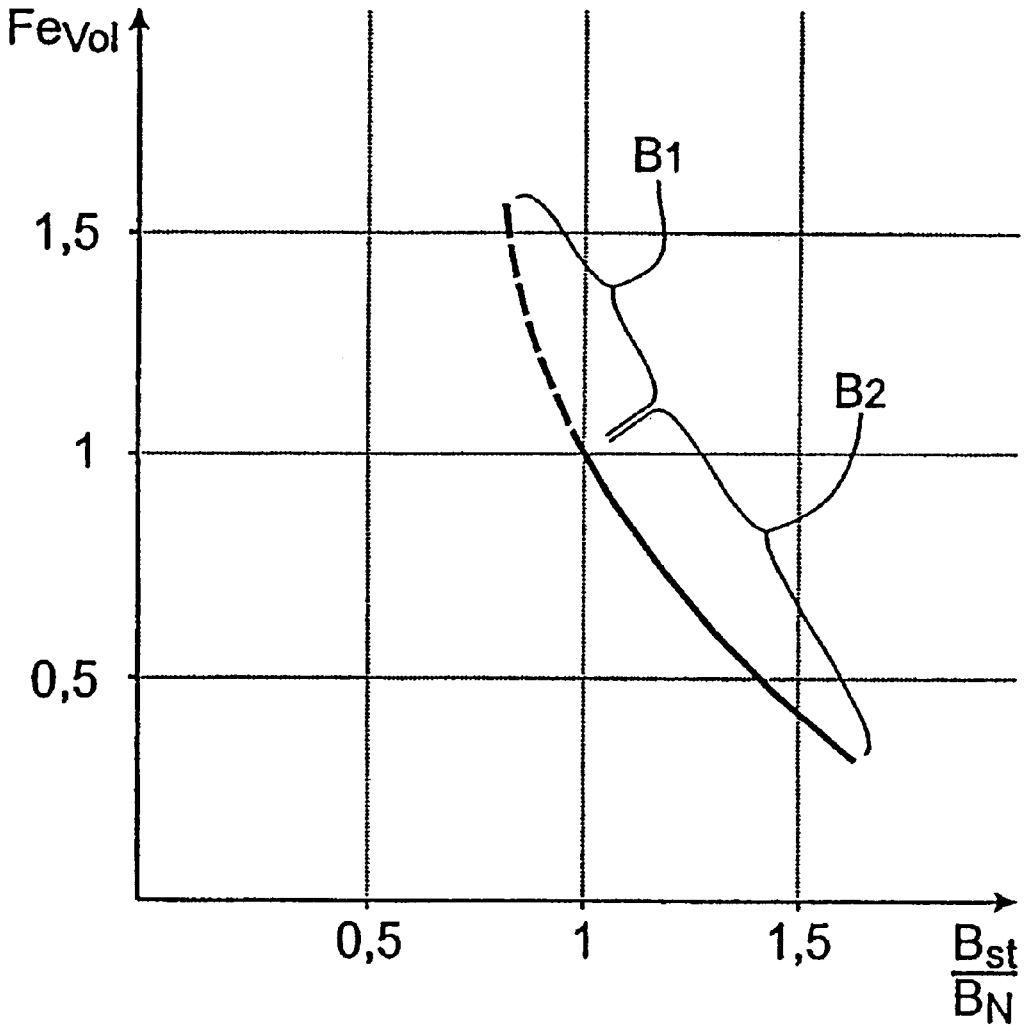
FIG. 4 shows comparative views of the iron losses in dependence on induction in the case of conventional chokes and chokes according to the invention.

FIG. 4 shows the comparison of the required amount of iron (weight) of the iron core of a choke. The volume of iron required $Fe_{Vol}$ (weight) is plotted on the Y-axis. The X-axis shows the relative magnetic induction B.

The iron losses which respectively occur are constant for the curve shown. With the new cooling procedure, more losses can be removed per unit of surface area. Thus, as the curve shows, the choke can be of a substantially smaller structure.

It is to be noted in this respect that the steps according to the invention mean that the chokes can be acted upon by a much higher-level of induction, in which respect iron losses per kilogram of iron still remain markedly lower than in the case of conventional chokes. That means that the range of critical iron losses is achieved with the choke according to the invention at a substantially higher level of induction B, while the choke according to the invention is of a considerably smaller structural size than conventional chokes.

What is claimed is:

1. An induction arrangement, comprising:

a) a magnetic circuit having a surface area and having at least two limbs connected by at least one yoke, b) an electrical circuit having at least one metal winding, and c) the limbs being formed by a plurality of laminated plates each having a surface area, the laminated plates being displaced relative to each other to expose at least a portion of the surface area of more than one of the laminated plates and said laminated plates of at least one of said limbs being oriented along planes, which are oriented perpendicular to a plane formed by the said at least one limb and said at least one yoke and further being oriented parallel to a rotation axis of said metal winding.

2. The induction arrangement according to claim 1, wherein one or more cooling passages are provided between at least one limb and one electrical circuit.

3. A transformer or choke having an induction arrangement according to claim 1, wherein at least two electrical circuits are coupled together by the magnetic circuit.

4. An induction arrangement comprising:

a) a magnetic circuit having a surface area and having at least two limbs connected by at least one yoke, b) an electrical circuit having at least one metal winding, and c) the limbs being formed by a plurality of plate packs of laminated plates, the plate packs each having a surface area, the plate packs displaced relative to each other to expose at least a portion of the surface area of more than one of the plate packs and said laminated plates of at least one of said being oriented along planes, which are oriented perpendicular to a plane formed by the said at least one limb and said at least one yoke and further being oriented parallel to a rotation axis of said metal winding.

5. The induction arrangement according to claim 4, wherein one or more cooling passages are provided between at least one limb and one electrical circuit.

6. A transformer or choke having an induction arrangement according to claim 4, wherein at least two electrical circuits are coupled together by the magnetic circuit.

* * * * *